United States Patent [19]

Newman

[11] 4,195,977

[45] Apr. 1, 1980

[54] ETHER DIAMINE SALTS OF N-ACYLSARCOSINES AND THEIR USE AS CORROSION INHIBITORS

[75] Inventor: Thomas C. Newman, Hinsdale, Ill.

[73] Assignee: Akzona Incorporated, Asheville, N.C.

[21] Appl. No.: 944,670

[22] Filed: Sep. 22, 1978

[51] Int. Cl.[2] ..... C10L 1/22

[52] U.S. Cl. ..... 44/71; 260/404.5; 252/392; 252/394; 252/396

[58] Field of Search ..... 44/71; 252/392, 394, 252/396; 260/404.5 A

[56] References Cited

U.S. PATENT DOCUMENTS

| | | | |
|---|---|---|---|
| 2,935,389 | 5/1960 | Titsworth et al. | 44/71 |
| 3,109,719 | 11/1963 | Eckert | 44/71 |
| 3,238,277 | 3/1966 | Sigan et al. | 44/72 |
| 3,404,165 | 10/1968 | Budde, Jr. et al. | 252/392 |
| 3,448,154 | 3/1969 | Broadhead et al. | 252/392 |

FOREIGN PATENT DOCUMENTS

| | | | |
|---|---|---|---|
| 1545248 | 8/1969 | Fed. Rep. of Germany | 44/72 |

*Primary Examiner*—Patrick Garvin
*Assistant Examiner*—Y. Harris-Smith
*Attorney, Agent, or Firm*—Francis W. Young; Robert F. Green

[57] ABSTRACT

Compositions containing ether diamine and salts thereof with N-acylsarcosines are disclosed. The ether diamine salts of N-acylsarcosines have the formula:

$$[R_1O(CH_2)_3NH(CH_2)_3NH_2].[HO_2CCH_2(CH_3-)NOCR_2]$$

wherein $R_1$ is an aliphatic group containing from about 6 to about 18 carbon atoms and $R_2$ is an aliphatic group containing from about 8 to about 18 carbon atoms. Also disclosed are fuel oil compositions containing said ether diamine and salts thereof, and a method for inhibiting corrosion utilizing said ether diamine salts.

28 Claims, No Drawings

ETHER DIAMINE SALTS OF N-ACYLSARCOSINES AND THEIR USE AS CORROSION INHIBITORS

BACKGROUND OF THE INVENTION

This invention relates to novel corrosion inhibitors, their use in fuel oil compositions, and the resulting fuel oil containing the corrosion inhibitors.

A constant concern of manufacturers and distributors of liquid hydrocarbons, such as fuel oil, is the corrosion of metal used for storage and transport. Corrosion of metal in storage tanks and pipelines can, of course, lead to loss of the liquid hydrocarbon, replacement and repair of tanks, lines, and fittings, and undesirable contamination of the environment. Such corrosion is primarily caused by the presence of water contamination. However, in certain liquid hydrocarbons, such as gasoline, which contain many ingredients, corrosion may even be promoted by the presence of such additives.

Many solutions have been suggested in the past to prevent or inhibit the corrosion of construction materials, in particular mild steel, used for containment or transportation of liquid hydrocarbons. However, many such solutions entail the addition of additives to the system in typically large quantities. Furthermore, such additives often promote the formation of water-in-oil emulsions, which is undesirable. Also, certain physical properties of some suggested corrosion inhibitors, such as viscosity, or ease of handling in the field, have been found to be undesirable.

Included in the suggested corrosion inhibitors are diamine salts of acylsarcosines, as taught in U.S. Pat. No. 2,935,389, and lower-alkyl ether monoamine salts of acylsarcosines, as taught in German Pat. No. 1,545,248. Also suggested have been alkyl ether amine salts of alkyl phosphorous acids, as taught in U.S. Pat. No. 3,238,277 and morpholine salts of acylsarcosines, as taught in U.S. Pat. No. 2,935,389. It has also been known that ether diamines, alone, are effective corrosion inhibitors in some applications.

An object of this invention is to provide a corrosion inhibitor for use in liquid hydrocarbons which is effective at low dosage levels and does not unduly promote the formation of water-in-oil emulsions.

SUMMARY OF THE INVENTION

Ether diamine salts of N-acylsarcosines having the formula:

$$[R_1O(CH_2)_3NH(CH_2)_3NH_2].[HO_2CCH_2(CH_3)NOCR_2]$$

wherein $R_1$ is an aliphatic group containing from about 6 to about 18 carbon atoms and $R_2$ is an aliphatic group containing from about 8 to about 18 carbon atoms, have been found to be effective corrosion inhibitors for use in liquid hydrocarbons.

There has thus been discovered corrosion inhibited compositions comprising a normally liquid hydrocarbon, such as fuel oil, and from about one to about ten parts per million, by weight, of an ether diamine/ether diamine salt composition wherein from about 10 to about 100 percent of the ether diamine having the formula:

$$R_1O(CH_2)_3NH(CH_2)_3NH_2$$

wherein $R_1$ is an aliphatic group containing from about 6 to about 18 carbon atoms, has been neutralized with an N-acylsarcosine having the formula:

$$HOOCCH_2(CH_3)NOCR_2$$

wherein $R_2$ is an aliphatic group containing from about 8 to about 18 carbon atoms, to form the ether diamine salt.

Also discovered has been a method for inhibiting the corrosion of metal used for containment or transportation of a liquid hydrocarbon, such as fuel oil. The method comprises adding to the liquid hydrocarbon an effective amount of an ether diamine salt of an N-acylsarcosine having the formula stated hereinabove.

Furthermore, there has been discovered a method for inhibiting the corrosion of metal surfaces in contact with a liquid hydrocarbon, caused by water contamination, comprising adding to said liquid hydrocarbon an effective amount of an ether diamine/ether diamine salt composition wherein from about 10 to about 100 percent of the ether diamine having the foregoing formula has been neutralized with an N-acylsarcosine of the foregoing formula.

DETAILED DESCRIPTION OF THE PREFERRED EMBODIMENTS

As indicated, a new class of corrosion inhibitors has now been discovered. The corrosion inhibitors are ether diamines and salts thereof with N-acylsarcosines wherein the salts have the formula:

$$[R_1O(CH)_3NH(CH_2)_3NH_2].[HO_2CCH_2(CH_3)NOCR_2]$$

wherein $R_1$ is an aliphatic group containing from about 6 to about 18 carbon atoms and $R_2$ is an aliphatic group containing from about 8 to about 18 carbon atoms.

Preferably, $R_1$ contains from about 6 to about 18 carbon atoms and most preferably from about 8 to about 15 carbon atoms. Also, preferably, $R_1$ is an alkyl or alkenyl group. $R_1$ may be either straight or branched chain. Most preferably the backbone of the aliphatic group contains from about 6 to about 15 carbon atoms. The backbone of the aliphatic group is simply the straight-chain portion of the group to which the branching is pendant. Thus, in an ether diamine derived from isotridecyl alcohol, the backbone contains nine carbon atoms.

$R_2$ preferably contains from about 8 to about 18 carbon atoms and most preferably contains from about 10 to about 16 carbon atoms. $R_2$ is typically an alkyl or alkenyl group which may be straight or branched chain.

Typical of the ether diamines which are useful in the practice of the present invention are Duomeen EA-13, Duomeen EA-25, Duomeen EA-26 and Duomeen EA-80 ether diamines which respectively may be described as:

N-tetramethylnonyloxypropyl-1,3-propane diamine, wherein the diamine is derived from an isomeric tridecyl alcohol consisting primarily of tetramethylnonyl alcohol;

N-alkyloxypropyl-1,3-propane diamine, wherein the alkyl portion is $C_{11}$ to $C_{16}$ with the distribution being approximately 2% $C_{11}$, 23% $C_{12}$, 25% $C_{13}$, 23% $C_{14}$, 25% $C_{15}$, and 2% $C_{16}$;

N-2-ethylhexyloxypropyl-1,3-propane diamine; and

N-alkyloxypropyl-1,3-propane diamine, wherein the alkyl portion is $C_6$ to $C_{10}$ with the approximate distribution being 3±2% $C_6$, 52±4% $C_8$, and 38±2% $C_{10}$; sold under the foregoing registered trademarks by Armak Company, Chicago, Ill.

The N-acylsarcosines which are useful in the practice of the present invention may be obtained, for example, from Ciba-Geigy. Typical of the useful N-acylsarcosines are N-lauroyl and N-stearoyl sarcosine.

The ether diamine salts of the N-acylsarcosines may be prepared utilizing any recognized neutralization technique. For example, simply stirring the desired reactants together for a sufficient length of time, such as one hour, produces the desired salt.

It has been found that the ether diamine salts are most desirous corrosion inhibitors due to the fact that, in addition to their excellent corrosion inhibition properties, they have low viscosities at room temperature, are less prone to form stable water-in-oil emulsions, and do not discolor the fuel oil to which they may be added, as does sarcosine alone.

A more detailed understanding of the present invention may be obtained by referring to the following non-limiting examples.

EXAMPLE I

60% SARCOSINE SALT OF N-TETRAMETHYLNONYLOXYPROPYL-1,3-PROPANE DIAMINE 51 grams (0.3 equivalents) of N-tetramethylnonyloxypropyl-1,3-propane diamine (Duomeen EA-13) having a neutralization equivalent of 168 was weighed into a 200 ml beaker and 49 grams (0.18 equivalents) of N-lauroyl sarcosine (Sarkosyl L, Ciba-Geigy) having an average molecular weight of 270 was subsequently added thereto. The resultant mixture was stirred for approximately one hour at room temperature to produce a clear amber liquid.

EXAMPLES II–IV

In a manner similar to Example I, the 60% sarcosine salts of (II) N-alkyloxypropyl-1,3-propane diamine, wherein the alkyl portion is $C_{11}$ to $C_{16}$ (Duomeen EA-25), (III) N-2-ethylhexyloxypropyl-1,3-propane diamine (Duomeen EA-26), and (IV) N-alkyloxypropyl-1,3-propane diamine, wherein the alkyl portion is $C_6$ to $C_{10}$ (Duomeen EA-80) were prepared.

COMPARATIVE EXAMPLE A

60% SARCOSINE SALT OF BUTYLOXYPROPYL-1,3-PROPANE DIAMINE

In a manner similar to Example I, 46 grams (0.33 equivalents) of butyloxypropyl-1,3-propane diamine having a neutralization equivalent of 138 was weighed into a 200 ml beaker to which 54 grams (0.2 equivalents) of N-lauroyl sarcosine (Sarkosyl L, Ciba-Geigy) was subsequently added. The resulting mixture was stirred for approximately one hour at room temperature to produce a dark liquid.

COMPARATIVE EXAMPLE B

In a manner similar to Comparative Example A, the 60% sarcosine salt of N-tallowalkyl-1,3-propane diamine (Duomeen T) and N-lauroyl sarcosine was prepared.

To evaluate the efficacy of the compounds of the present invention and to compare the same to certain related compounds, the following test procedure was utilized:

1. 2000 ml of untreated fuel oil is added to a 3 liter separatory funnel.
2. The required amount of inhibitor additive is added to the separatory funnel. For all of the tests the inhibitor was first diluted to a 1.00% solution in uninhibited fuel oil, then accurately weighed to provide the desired dosage.
3. The funnel is shaken for 30 seconds to disperse the additive.
4. 20 ml of a 2% sodium chloride solution is added to the separatory funnel by pipette.
5. The funnel is shaken for 30 seconds to disperse the water.
6. The separatory funnel is then allowed to stand for 15 minutes.
7. A 1020 mild steel coupon measuring 1"×0.5"×0.011" is degreased in acetone, air dried, and placed in a 30 gram screw cap vial. The water is drained from the separatory funnel into the vial containing the steel coupon.
8. The vial is sealed and held at room temperature for a period of one week. The metallic corrosion is visually noted and recorded in terms of the percent of the surface area which is corroded.

The results of the foregoing test procedure as applied to the compounds of Examples I–IV and Comparative Examples A and B are summarized in Table I, utilizing various levels of corrosion inhibitor addition.

TABLE I

| Composition | | 60% N-lauroyl Sarcosinate Amine Salts % Corrosion | | | | | | | |
|---|---|---|---|---|---|---|---|---|---|
| of Example | PPM | Days | 1 | 2 | 3 | 4 | 5 | 6 | 7 |
| A | 20 | | 1 | 1 | 1 | 1 | — | 1 | 5 |
| A | 10 | | 5 | 10 | 30 | 75 | — | 100 | 100 |
| B | 10 | | 0 | 0 | 0 | — | 0 | 0 | 0 |
| III | 10 | | 0 | 0 | — | 0 | 0 | 0 | 0 |
| II | 10 | | 0 | 0 | — | 0 | 0 | 0 | 0 |
| IV | 10 | | 0 | 0 | — | 0 | 0 | 0 | 0 |
| A | 5 | | 5 | 10 | 30 | 100 | — | 100 | 100 |
| B | 5 | | 15 | 20 | 100 | — | 100 | 100 | 100 |
| III | 5 | | 1 | 1 | — | 80 | 80 | 80 | 100 |
| II | 5 | | 0 | 0 | — | 0 | 0 | 0 | 0 |
| IV | 5 | | 0 | 0 | — | 10 | 50 | 100 | 100 |
| I | 5 | | 0 | 0 | 0 | 0 | — | 0 | 0 |
| A | 2.5 | | 10 | 100 | 100 | 100 | — | 100 | 100 |
| B | 2.5 | | 75 | 100 | 100 | — | 100 | 100 | 100 |
| III | 2.5 | | 40 | 100 | — | 100 | 100 | 100 | 100 |
| II | 2.5 | | 5 | 5 | — | 100 | 100 | 100 | 100 |

TABLE I-continued

| Composition of Example | PPM | 60% N-lauroyl Sarcosinate Amine Salts % Corrosion Days 1 | 2 | 3 | 4 | 5 | 6 | 7 |
|---|---|---|---|---|---|---|---|---|
| IV | 2.5 | 5 | 10 | — | 100 | 100 | 100 | 100 |
| I | 2.5 | 0 | 0 | — | 0 | 0 | 0 | 0 |
| B | 1.0 | 100 | 100 | 100 | — | 100 | 100 | 100 |

To determine the optimum degree of neutralization of the ether diamine, 10, 40, 60 and 100% sarcosinate salts of Duomeen EA-13 and N-lauroyl sarcosine were prepared and subjected to the foregoing test procedure. The results of the test are summarized in Table II.

TABLE II

| Degree of Neutralization in Percent | PPM | N-Lauroyl Sarcosinate Salt of N-tetramethylnonyloxypropyl-1,3-propane diamine (Duomeen EA-13) % Corrosion Days 1 | 2 | 3 | 5 | 6 | 7 |
|---|---|---|---|---|---|---|---|
| 10 | 10 | 0 | 0 | 0 | 0 | 0 | 0 |
| 10 | 5 | 0 | 0 | 0 | 0 | 0 | 0 |
| 40 | 5 | 0 | 0 | 0 | 0 | 0 | 0 |
| 60 | 5 | 0 | 0 | 0 | 0 | 0 | 0 |
| 100 | 5 | 0 | 0 | 0 | 0 | 0 | 0 |
| 10 | 2.5 | 10 | 75 | 100 | 100 | 100 | 100 |
| 40 | 2.5 | 15 | 50 | 100 | 100 | 100 | 100 |
| 60 | 2.5 | 0 | 0 | 0 | 0 | 0 | 0 |
| 100 | 2.5 | 10 | 20 | 75 | 100 | 100 | 100 |
| 10 | 1.0 | 90 | 100 | 100 | 100 | 100 | 100 |
| 40 | 1.0 | 75 | 75 | 100 | 100 | 100 | 100 |
| 60 | 1.0 | 50 | 50 | 50 | 75 | 75 | 80 |
| 60 | 0.5 | 90 | 100 | 100 | 100 | 100 | 100 |
| 100 | 1.0 | 50 | 100 | 100 | 100 | 100 | 100 |
| 100 | 0.5 | 100 | 100 | 100 | 100 | 100 | 100 |

From Table II, it is apparent that the 60% salt (wherein the ether diamine is 60 percent neutralized with sarcosine) is the most effective. However, the 10, 40, and 100% salts were found to be essentially identical to each other.

To compare the effectiveness of the ether diamine salts made from N-acylsarcosines having aliphatic radicals of varying chain length, 60% salts of N-tetramethylnonyloxypropyl-1,3-propane diamine (Duomeen EA-13) were made from N-stearoyl sarcosine and N-lauroyl sarcosine. The results of the comparison, utilizing the foregoing test procedure are shown in Table III.

TABLE III

| Salt | PPM | 60% Sarcosinate Salts of Duomeen EA-13 % Corrosion Days 1 | 2 | 3 | 4 | 5 | 6 | 7 |
|---|---|---|---|---|---|---|---|---|
| N-Stearoyl | 10 | 0 | | — | 0 | 0 | 0 | 0 |
| N-Steroyl | 5 | 20 | 100 | — | 100 | 100 | 100 | 100 |
| N-Lauroyl | 5 | 0 | 0 | 0 | 0 | — | 0 | 0 |
| N-Stearoyl | 2.5 | 90 | 100 | — | 100 | 100 | 100 | 100 |
| N-Lauroyl | 2.5 | 0 | 0 | 0 | 0 | — | 0 | 0 |

To compare the effectiveness of the corrosion inhibitors of the present invention with commercially utilized corrosion inhibitors and the individual components of the ether diamine salts of N-acylsarcosines, the test procedure described herein-above was modified so that the sodium chloride solution utilized was a 0.5% solution, rather than a 2.0% solution, and N-s-(alkyl $C_{11}$ to $C_{14}$)-1,3-propane diamine (Duomeen L-11), the ether diamine from Example I (Duomeen EA-13), and N-lauroyl sarcosine were tested at various concentration levels. The results, summarized in Table IV, show that for the commercial product, N-s (alkyl $C_{11}$ to $C_{14}$)-1,3-propane diamine, corrosion existed after 2 days, even at 20 ppm, whereas, for example, the N-lauroyl sarcosinate amine salts of Examples I through IV prevented corrosion at 10 ppm or less under more severe conditions, utilizing a 2% sodium chloride solution.

The results also demonstrate that the components, the ether diamine and the N-lauroyl sarcosinate, alone are not very effective corrosion inhibitors, at 20 ppm for the ether diamine and 40 ppm for the N-lauroyl sarcosine, utilizing the 0.5% sodium chloride solution.

TABLE IV

| Product | Dosage | % Corrosion Days 1 | 2 | 3 | 4 | 5 | 6 | 7 |
|---|---|---|---|---|---|---|---|---|
| N-s-(alkyl $C_{11}$ to $C_{14}$)-1,3-propane diamine (Duomeen L-11) | 20 ppm | 0 | 2 | 2 | — | — | — | 5 |
| | 10 ppm | 5 | 5 | 5 | — | — | — | 100 |
| | 5 ppm | 5 | 90 | 100 | — | — | — | 100 |
| (Duomeen EA-13) ether diamine as utilized in Example I | 20 ppm | 0 | 0 | 5 | — | — | — | 10 |
| | 10 ppm | 1 | 1 | 5 | — | — | — | 100 |
| | 5 ppm | 5 | 80 | 100 | — | — | — | 100 |
| N-lauroyl sarcosine | 40 ppm | 40 | 75 | 100 | — | — | — | 100 |

What is claimed is:

1. An ether diamine salt of an N-acylsarcosine, having the formula $$[R_1O(CH_2)_3NH(CH_2)_3NH_2][HO_2CCH_2(CH_3)NOCR_2]$$

wherein $R_1$ is an aliphatic group containing from about 6 to about 18 carbon atoms and $R_2$ is an aliphatic group containing from about 8 to about 18 carbon atoms.

2. The salt of claim 1 wherein $R_1$ contains from about 8 to about 15 carbon atoms.

3. The salt of claim 1 or 2 wherein $R_1$ is an alkyl or alkenyl group.

4. The salt of claim 1 wherein $R_1$ is an aliphatic group having a backbone containing from about 6 to about 15 carbon atoms.

5. The salt of claim 1 or 2 wherein $R_2$ contains from about 10 to about 16 carbon atoms.

6. The salt of claim 5 wherein $R_2$ is an alkyl or alkenyl group.

7. A composition comprising a mixture of one or more ether diamines and salts thereof with at least one N-acylsarcosine wherein the ether diamine is selected from the group consisting of ether diamines having the formula $$R_1O(CH_2)_3NH(CH_2)_3NH_2$$

wherein $R_1$ is an aliphatic group containing from about 6 to about 18 carbon atoms and the N-acylsarcosine is selected from the group consisting of N-acylsarcosines having the formula $$HOOCCH_2(CH_3)NOCR_2$$

wherein $R_2$ is an aliphatic group containing from about 8 to about 18 carbon atoms and wherein from about 10 percent to about 100 percent of the ether diamine is present in the form of the sarcosinate salt.

8. The composition of claim 7 where $R_1$ contains from about 8 to about 15 carbon atoms.

9. The composition of claim 7 or 8 wherein $R_1$ is an alkyl or alkenyl group.

10. The composition of claim 7 wherein $R_1$ is an aliphatic group having a backbone containing from about 6 to about 15 carbon atoms.

11. The composition of claim 7 wherein $R_2$ contains from about 10 to about 16 carbon atoms.

12. The composition of claim 7 or 8 wherein $R_2$ is an alkyl or alkenyl group.

13. A corrosion inhibited normally liquid hydrocarbon comprising said hydrocarbon and an effective amount of a corrosion inhibiting composition comprising a mixture of one or more ether diamines and salts thereof with at least one N-acylsarcosine wherein the ether diamine is selected from the group consisting of ether diamines of the formula $$R_1O(CH_2)_3NH(CH_2)_3NH_2$$

wherein $R_1$ is an aliphatic group containing from about 6 to about 18 carbon atoms and the N-acylsarcosine is selected from the group consisting of N-acylsarcosines having the formula $$HOOCCH_2(CH_3)NOCR_2$$

wherein $R_2$ is an aliphatic group containing from about 8 to about 18 carbon atoms, and wherein from about 10 percent to about 100 percent of the ether diamine is present in the form of the sarcosinate salt.

14. The corrosion inhibited hydrocarbon of claim 13 wherein $R_1$ contains from about 8 to about 15 carbon atoms.

15. The corrosion inhibited hydrocarbon of claim 13 or 14 wherein $R_1$ is an alkyl or alkenyl group.

16. The corrosion inhibited hydrocarbon of claim 13 wherein $R_1$ is an aliphatic group having a backbone containing from about 6 to about 15 carbon atoms.

17. The corrosion inhibited hydrocarbon of claim 13 or 14 wherein $R_2$ contains from about 10 to about 16 carbon atoms.

18. The corrosion inhibited hydrocarbon of claim 13 or 14 wherein $R_2$ is an alkyl or alkenyl group.

19. The corrosion inhibited hydrocarbon of claim 13 wherein the hydrocarbon is fuel oil.

20. The corrosion inhibited hydrocarbon of claim 17 wherein from about one to about 10 parts per million of the corrosion inhibiting composition is utilized.

21. A method for inhibiting corrosion of metal used for containment or transportation of a normally liquid hydrocarbon comprising adding to the hydrocarbon an effective amount of a corrosion inhibiting composition comprising a mixture of one or more ether diamines and salts with at least one N-acylsarcosine wherein the ether diamine is selected from the group consisting of ether diamines of the formula $$R_1O(CH_2)_3NH(CH_2)_3NH_2$$

wherein $R_1$ is an aliphatic group containing from about 6 to about 18 carbon atoms, and the N-acylsarcosine is selected from the group consisting of N-acylsarcosines having the formula $$HOOCCH_2CH_3NOCR_2$$

wherein $R_2$ is an aliphatic group containing from about 8 to about 18 carbon atoms, and wherein from about 10 percent to about 100 percent of the ether diamine is present in the form of the sarcosinate salt.

22. The method of claim 21 wherein $R_1$ contains from about 8 to about 15 carbon atoms.

23. The method of claim 21 or 22 wherein $R_1$ is an alkyl or alkenyl group.

24. The method of claim 21 wherein $R_1$ is an aliphatic group having a backbone containing from about 6 to about 15 carbon atoms.

25. The method of claim 21 or 22 wherein $R_2$ contains from about 10 to about 16 carbon atoms.

26. The method of claim 21 or 22 wherein $R_2$ is an alkyl or alkenyl group.

27. The method of claim 21 wherein the hydrocarbon is fuel oil.

28. The method of claim 26 wherein from about one to about 10 parts per million of the corrosion inhibiting composition is utilized.

* * * * *